US007402116B2

(12) United States Patent
Zuccarini et al.

(10) Patent No.: US 7,402,116 B2
(45) Date of Patent: Jul. 22, 2008

(54) CONTRACTING BASKETBALL HOOP

(76) Inventors: Daniel P. Zuccarini, 22 Meadowridge Dr., Shelton, CT (US) 06484; Steven J. Gordon, 25 Rolling La., Weston, MA (US) 02493

( * ) Notice: Subject to any disclaimer, the term of this patent is extended or adjusted under 35 U.S.C. 154(b) by 282 days.

(21) Appl. No.: 11/054,922

(22) Filed: Feb. 9, 2005

(65) Prior Publication Data

US 2005/0176527 A1 Aug. 11, 2005

Related U.S. Application Data

(60) Provisional application No. 60/542,833, filed on Feb. 9, 2004.

(51) Int. Cl.
*A63B 63/08* (2006.01)

(52) U.S. Cl. ..... 473/485

(58) Field of Classification Search ..... 473/480–487, 473/433, 434, 479, 449, 447, 450, 451; 248/231.41, 248/292.14; D21/701, 702
See application file for complete search history.

(56) References Cited

U.S. PATENT DOCUMENTS 1,535,398 A * 4/1925 Carver ..... 301/34
1,980,652 A * 11/1934 Wiezel et al. ..... 473/480
2,230,813 A * 2/1941 Pressman ..... 473/481
2,401,969 A * 6/1946 Schlank ..... 223/95
2,451,829 A * 10/1948 Hightower ..... 248/100
3,729,860 A * 5/1973 Kargul ..... 446/236
4,358,083 A * 11/1982 Haubrich ..... 248/545
5,100,133 A * 3/1992 Riviezzo et al. ..... 473/485
5,779,570 A * 7/1998 Bear ..... 473/481
5,813,928 A * 9/1998 Hsieh ..... 473/480
5,823,897 A * 10/1998 Wang ..... 473/481
6,913,551 B1 * 7/2005 Foley ..... 473/448

* cited by examiner

*Primary Examiner*—Gene Kim
*Assistant Examiner*—M Chambers
(74) *Attorney, Agent, or Firm*—Bachmand & LaPointe, P.C.

(57) ABSTRACT

A basketball goal system is provided which helps improve the shooting skills of a use. The system includes a rim which is expandable and contractable in diameter. The rim has a pair of free ends which are caused to be moved relative to each other to change the rim diameter. Attached to each of the free ends is a device for causing such relative movement and thereby the expansion and contraction of the rim.

18 Claims, 4 Drawing Sheets

CONTRACTING BASKETBALL HOOP

CROSS-REFERENCE TO RELATED APPLICATIONS

The benefit of U.S. Provisional patent application 60/542,833, filed Feb. 9, 2004, is hereby claimed.

BACKGROUND OF THE INVENTION (1) Field of the Invention

The present invention relates to a basketball rim which has a variable diameter and which can be contracted/expanded to help improve the shooting skills of a user.

(2) Prior Art

In the game of basketball, it is well known that extensive practice by shooting a ball through a standard size hoop improves the frequency of making a goal. Using a hoop of smaller diameter during practice can further improve a shooter's skill or "touch". Smaller diameter practice hoops which clamp onto standard size basketball rims are commercially available. However, installation of these smaller diameter practice hoops require manual steps for attaching and detaching the practice hoop to an existing rim. As a standard rim is ten feet off the ground, the attachment and detachment steps must be performed with the use of a ladder. Furthermore, a clamp-on practice rim is not as effective as a plain small rim, as the double rim created by the detachable device is distracting to the user and does not allow development of accuracy skills in the normal course of shooting a basketball into a goal.

Conventional rims are also available which are smaller than a standard size; however, these are typically kept in place rather than frequently exchanged with a standard size rim as they require extensive time and tools to perform the exchange.

SUMMARY OF THE INVENTION

Accordingly, it is an object of the present invention to provide a basketball goal system having a contractable basketball rim for allowing users to improve their skills.

It is a further object of the present invention to provide a basketball goal system as above which avoids having to manually attach and detach a peripheral practice rim device.

The foregoing objects are attained by the basketball goal system of the present invention.

In accordance with the present invention, a basketball goal system broadly comprises a basketball rim having a diameter and means for expanding and contracting the rim so as to change the diameter.

Other details of the basketball goal system of the present invention, as well as other objects and means attendant thereto are set forth in the following detailed description and the accompanying drawings wherein like reference numerals depict like elements.

DETAILED DESCRIPTION OF THE PREFERRED EMBODIMENT(S)

Figure 1:
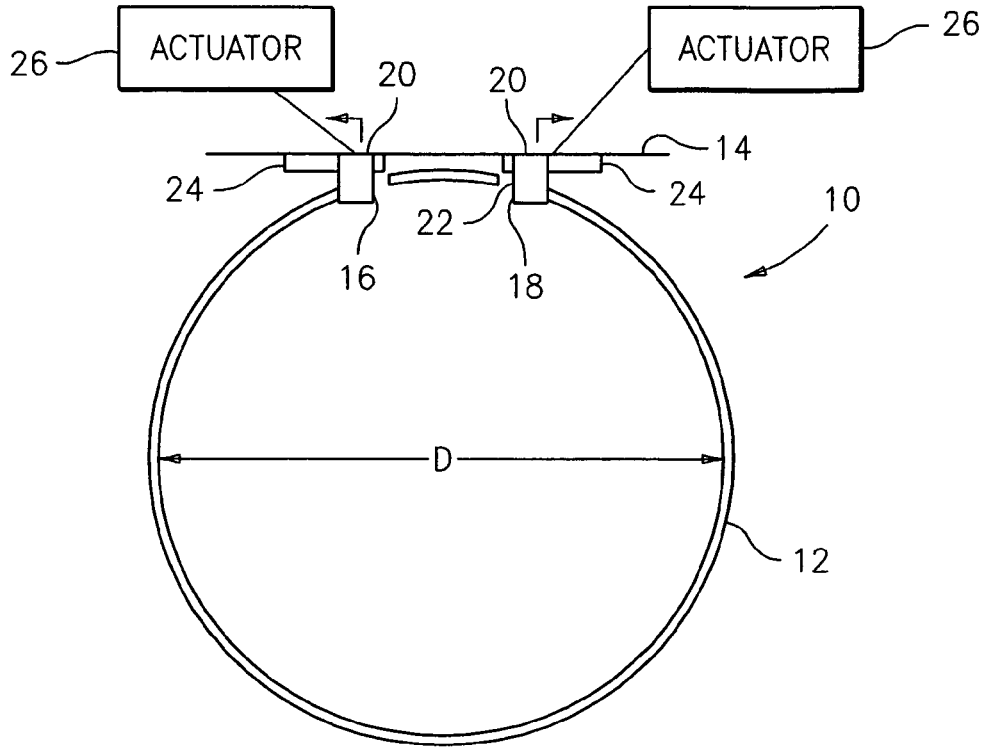
FIG. 1 illustrates a first embodiment of a basketball goal system in accordance with the present invention.

FIG. 1 illustrates a first embodiment of a basketball goal system 10 in accordance with the present invention. The system 10 includes a basketball rim 12 having a substantially circular configuration and a diameter D. The basketball rim 12 may be formed from any suitable material known in the art. Typically, the basketball rim 12 is formed from a metallic material, such as steel, although it could be formed from a plastic material if desired. The rim 12 may be formed from a rod of material having one of a wide variety of cross sections. The rim 12 may also have additional supports (not shown) which stiffen the rim in a vertical direction.

The system 10 further includes a backboard 14 to which the rim 12 is mounted. The backboard 14 may also be made from any suitable material known in the art. For example, the backboard 14 may be made from a clear plastic material, wood, or metal.

Figure 8:
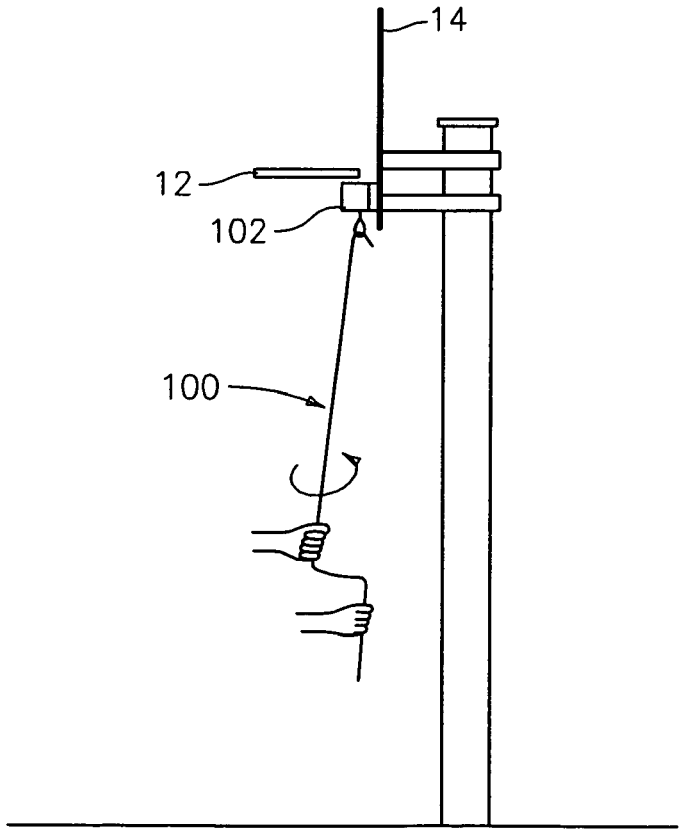
FIG. 8 illustrates a manually operated crank for actuating the basketball goal system of the present invention.

As can be seen in FIG. 1, the rim 12 is not entirely closed and has at least one movable end 16 and 18 which are spaced from each other. Means for expanding and contracting the rim 12 to change the diameter D of the rim 12 are attached to the ends 16 and 18. The expanding and contracting means may include a movable member 20 connected to at least one of the ends 16 and 18. The movable member 20 preferably has a bore 22 through which a stationary or a rotational co-operating member 24 passes. The co-operating member 24 may be attached to the backboard 14 using any suitable attachment system known in the art. If desired, the co-operating member 24 may be a linear bearing. The expanding and contracting means may further include one or more actuators 26 to cause at least one of the respective members 20 to move along at least one of the respective members 24 to change the diameter of the rim so that the rim 12 either contracts or expands. The actuator(s) 26 may comprise any suitable manual or motorized actuator known in the art. For example, the actuator(s) 26 may be a cable or rope attached to each of the members 20. The cable or rope may be attached to a suitable pulley system (not shown) which allows the ends 16 and 18 to move relative to each other. Alternatively, as shown in FIG. 8, the actuator(s) 26 may comprise a detachable manual crank 100 connected to a gear arrangement 102 for driving one or both of the co-operating members 24.

Alternatively, the co-operating member 24 may comprises a motor driven screw having external threads (not shown) which engage internal threads (not shown) in the bore 22 of the connector 20. The actuator(s) 26 may comprise one or more motors for rotating the members 24. The motor(s) may be attached to the backboard 14 or a support for the backboard 14 in any desired manner. If desired, the motor(s) may be operated by a remote control (not shown).

Figure 2:
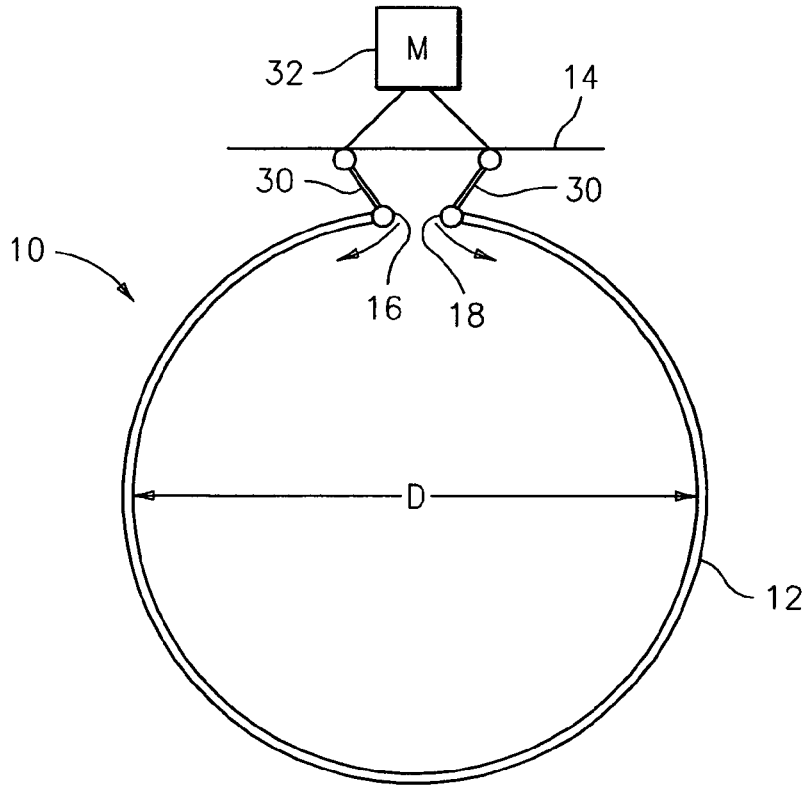
FIG. 2 illustrates a second embodiment of a basketball goal system in accordance with the present invention.

Referring now to FIG. 2, a second embodiment of the present invention is illustrated. In this embodiment, the free ends 16 and 18 of the rim 12 are attached to link members 30 which are pivotable relative to the backboard 14. Each of the link members 30 may be pivotably mounted to the backboard 14 and to a respective one of the ends 16 and 18 using any suitable connection means, such as a hinge, known in the art. If desired, the link members 30 may be connected to a motor 32 which causes the members 30 to rotate relative to the backboard 14. By causing rotation of the members 30, the free ends 16 and 18 may be caused to move towards or away from each other to expand or contract the diameter D of the rim 12.

In addition to being utilized for actuating and moving the ends 16 and 18 of the rim, the hinges used in the embodiment of FIG. 2 may be used as a kinematic constraint to provide increased vertical stiffness for the rim and may be combined with other actuation embodiments described herein. A linear bearing system such as the co-operating members 24 in FIG. 1 may also be utilized for vertical kinematic constraint.

Figure 3:
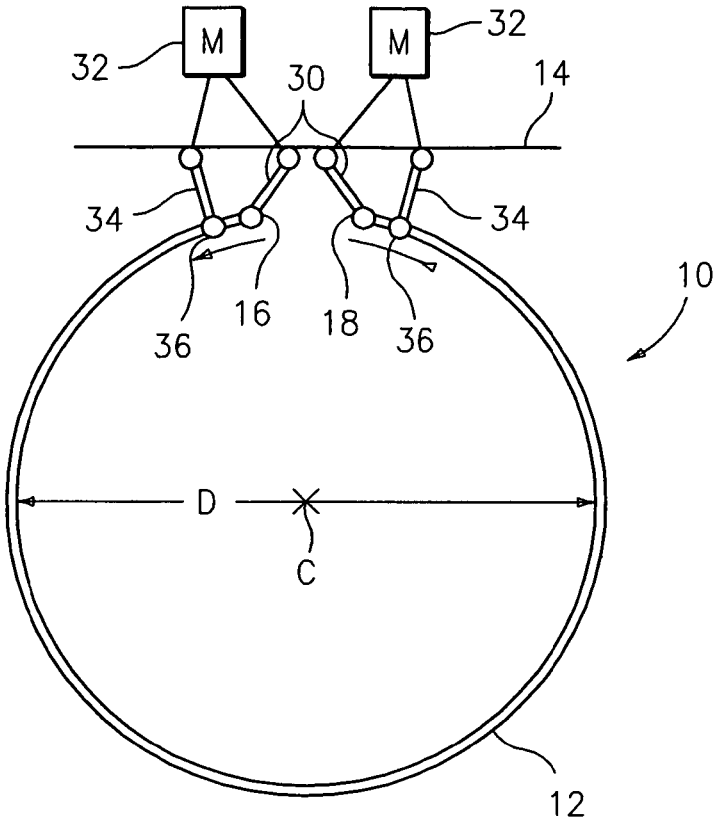
FIG. 3 illustrates a third embodiment of a basketball goal system in accordance with the present invention.

Referring now to FIG. 3, there is illustrated a third embodiment of the basketball goal system of the present invention. In this embodiment, a first link member 30 is attached to each of the free ends 16 and 18. Further, a second link member 34 is attached to the backboard 14 and to a point 36 on the rim spaced from a respective end 16, 18. Each of the pairs of link members 30 and 34 may be attached to one or more motor(s) 32 which cause the members 30 and 34 to pivot relative to the backboard 14. In this system, it is not only possible to expand and/or contract the diameter D of the rim 12, but it is also possible to change the location of the center C of the rim 12.

Figure 4:
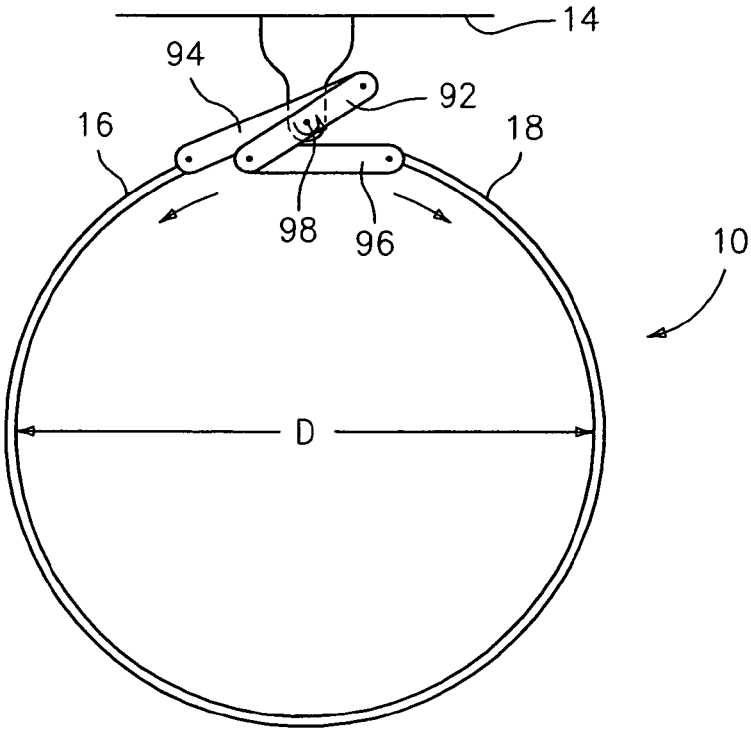
FIG. 4 illustrates a fourth embodiment of a basketball goal system in accordance with the present invention.

Referring now to FIG. 4, there is shown a basketball goal system 10 which uses a toggle mechanism 90 to expand and contract the diameter D of the rim 12. The toggle mechanism 90 comprises a drive link 92 and two driven links 94 and 96. The drive link 92 may rotate about pivot point 98. Each of the driven links 94 and 96 is attached to one end of the drive link 92 and one of the free ends 16 and 18 of the rim 12. In operation, suitable manual or motor means (not shown) may be provided for causing the drive link 92 to rotate about the pivot point 98. Rotation of the drive link 92 causes movement of the driven links 94 and 96 and depending on whether the rotation is clockwise or counter-clockwise, movement of the free ends 16 and 18 towards or away from each other. The movement of the free ends in turn causes contraction or expansion of the rim 12.

Figure 5:
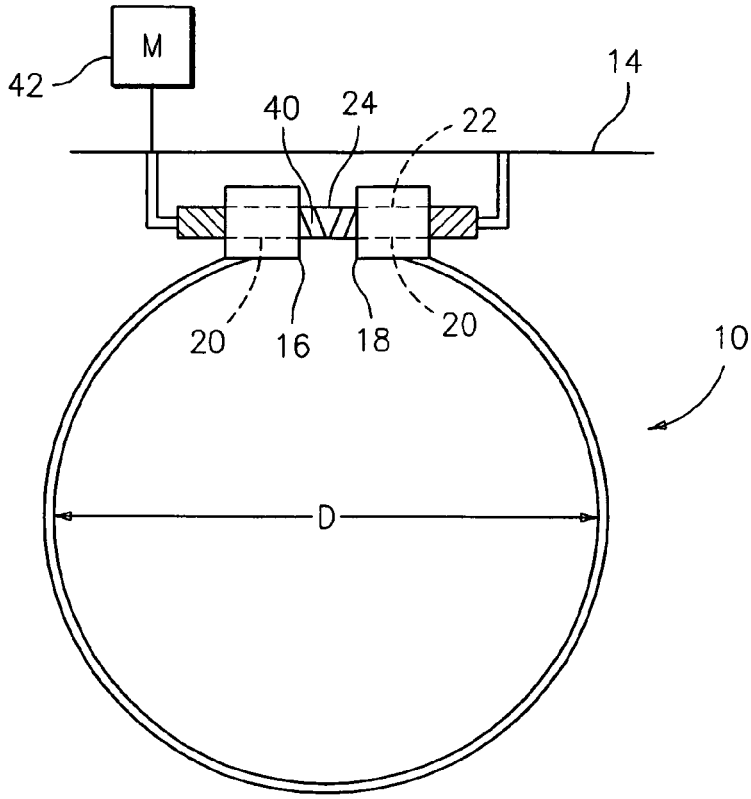
FIG. 5 illustrates a fifth embodiment of a basketball goal system in accordance with the present invention.

Referring now to FIG. 5, there is shown still another embodiment of a basketball goal system 10 in accordance with the present invention. As in the embodiment of FIG. 1, each of the free ends 16 and 18 of the rim 12 has a respective movable member 20 attached to it. Instead of dual co-operating members 24, only a single co-operating member 24 is mounted to the backboard 14. Preferably, the co-operating member 24 comprises a rotatable screw having an external thread 40 which mates with an internal thread (not shown) in the bore 22 of each member 20. The co-operating member 24 may be mounted to the backboard 14 using any suitable means known in the art. Further, the co-operating member 24 may be attached to a suitable motor or manual operator 42, by any suitable means known in the art, for causing the member 24 to rotate. The motor 42 may be mounted to the backboard 14 if desired. Alternatively, the motor 42 may be mounted to a support (not shown) for the backboard 14. The motor 42 causes the member 24 to rotate and depending on the direction of rotation cause the free ends 16 and 18 of the rim 12 to move towards or away from each other, thereby causing the diameter D of the rim 12 to change.

Figure 6:
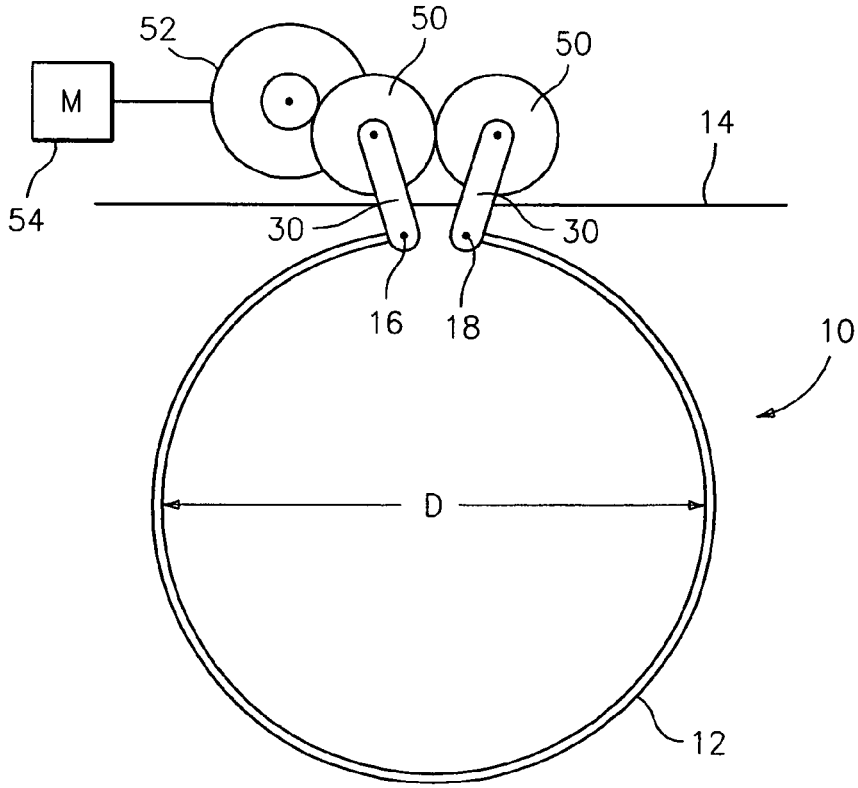
FIG. 6 illustrates a sixth embodiment of a basketball goal system in accordance with the present invention.

Referring now to FIG. 6, there is shown still another embodiment of the basketball goal system 10 of the present invention. In this embodiment, the means for expanding and contracting the rim 12 to change the diameter D of the rim 12 includes a pair of link members 30 attached to the free ends 16 and 18 of the rim 12. The ends of the link members 30 remote from the free ends 16 and 18 are connected to gears 50. The gears 50 may be caused to rotate by a drive gear 52 which is driven by a motor 54 using any suitable arrangement known in the art. Rotation of the gear member 52 causes the link members 30 to rotate towards or away from each other. This in turn causes the free ends 16 and 18 of the rim 12 to move towards or away from each other. As a result, the diameter D of the rim 12 is changed and the rim 12 will expand or contract. In this embodiment, the link members 30, the gears 50 and 52, and the motor 54 may be connected to the backboard 14 using any suitable means known in the art. Alternatively, they may be connected to a support for the backboard 14.

Figure 7:
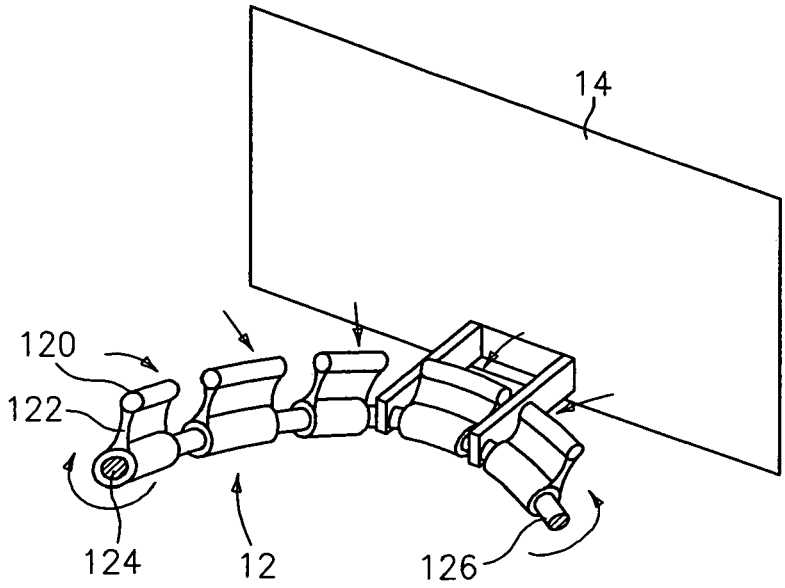
FIG. 7 illustrates a seventh embodiment of a basketball goal system in accordance with the present invention.

Referring now to FIG. 7, in yet another embodiment of the present invention, the rim 12 may be constructed from a plurality of arcuate sections 120. Each arcuate section has a supporting section 122 with a bore 124. If desired, the bore 124 may have internal threads (not shown). Positioned within the bore 124 is a portion of a flexible shaft 126, which may have an external thread (not shown) that mates with and engages the internal thread. The flexible shaft 126, when caused to be rotated by a motor or a manual operator (not shown), causes the arcuate sections to move towards or away from each other. This in turn causes the rim 12 to expand or contract. The flexible shaft 126 may be a continuous shaft that extends through all of the arcuate sections 120. If desired, the entire rim may be formed from the arcuate sections 120. Alternatively, only a portion of the rim 12 may be formed from the arcuate sections 120 with the remainder of the rim being formed by a continuous arcuate shaped member.

The present invention allows users to improve their skills through the use of a smaller rim without the tedious steps of using a ladder and manually attaching and detaching a peripheral practice rim device and without the distraction of a more complex looking rim system.

As can be seen from the foregoing description, the present invention allows a single standard size rim to be easily contracted to a smaller diameter for the purpose of practicing basketball shots. The present invention also allows for easy expansion of the rim back to a standard diameter or to a diameter larger than a standard diameter if desired.

It is apparent that there has been provided in accordance with the present invention a basketball goal system which fully satisfies the objects means and advantages set forth hereinbefore. While the present invention has been described in the context of specific embodiments thereof, other alternatives, modifications, and variations will become apparent to those skilled in the art having read the foregoing description. Accordingly, it is intended to embrace those alternatives, modifications, and variations as fall within the broad scope of the appended claims.

What is claimed is:

1. A basketball goal system comprising a backboard, a basketball rim having a diameter, and means for contracting and expanding said rim so as to change said diameter; and said means for contracting and expanding said rim having a co-operating member mounted directly to the backboard.

2. A basketball goal system according to claim 1, wherein said rim has a pair of free ends spaced apart from each other and at least one of said free ends is movable towards and away from the other.

3. A basketball goal system according to claim 2, wherein said contracting and expanding means comprises a connecting member attached to each of said ends and said co-operating member causing movement of at least one of said connecting members to move towards and away from the other.

4. A basketball goal system according to claim 3, wherein said co-operating member comprises at least one motor driven screw.

5. A basketball goal system according to claim 3, wherein said at least one co-operating member comprises a pair of motor driven screws.

6. A basketball goal system according to claim 3, wherein said at least one co-operating member comprises a pair of stationary members and each of said connecting members moves along a respective one of said stationary members.

7. A basketball goal system according to claim 6, further comprising means for causing at least one of said connecting members to move relative to said stationary members.

8. A basketball goal system according to claim 2, wherein said expanding and contracting means comprises a rotatable link member system attached to the free ends of said rim.

9. A basketball goal system according to claim 8, wherein said rotatable link member system comprises a pair of link members attached to said free ends of said rim and means for causing rotation of said link members to cause said free ends to move towards and away from each other.

10. A basketball goal system according to claim 8, wherein said rotatable link member system comprises a first pair of rotatable link members attached to said free ends of said rim and a second pair of rotatable link members attached to said rim at points spaced from said free ends and means for causing rotation of said first and second pairs of link members.

11. A basketball goal system according to claim 8, wherein said rotatable link member system comprises a pair of link members attached to said free ends of said rim and a gear means for causing rotation of said link members so that said free ends move towards and away from each other.

12. A basketball goal system according to claim 8, wherein said rotatable link member system comprises a toggle mechanism for causing said free ends of said rim to move towards and away from each other.

13. A basketball goal according to claim 2, further comprising the free ends of said rim being movable relative to said backboard.

14. A basketball goal system according to claim 2, wherein said contracting and expanding means comprises a detachable manual crank for cause movement of said at least one of said free ends.

15. A basketball goal system according to claim 1, wherein said rim is formed at least in part by a plurality of arcuate sections.

16. A basketball goal system according to claim 15, wherein each of said arcuate sections has a support member with a bore and said contracting and expanding means comprises a flexible shaft positioned within said bore of each said arcuate section.

17. A basketball goal system according to claim 1, wherein said co-operating means comprises a rotatable screw and said contracting and expanding means comprises a motor mounted to the backboard.

18. A basketball goal system according to claim 1, wherein said co-operating means comprises a rotatable screw and said contracting and expanding means comprises a motor mounted to a support for the backboard.

* * * * *